United States Patent [19]

Jorgens

[11] 4,391,113

[45] Jul. 5, 1983

[54] ONE-HAND KEY RING

[76] Inventor: Douglas M. Jorgens, 1527 Sitka Ave., Sun Valley, Calif. 93063

[21] Appl. No.: 289,507

[22] Filed: Aug. 3, 1981

[51] Int. Cl.[3] ..... A47G 29/10

[52] U.S. Cl. ..... 70/459

[58] Field of Search ..... 70/459, 456 R; 24/3 K, 24/241 SL, 263 SB

[56] References Cited

U.S. PATENT DOCUMENTS

| | | | |
|---|---|---|---|
| 1,219,873 | 3/1917 | Sapo | 70/459 |
| 1,489,244 | 4/1924 | Gnegy | 70/459 |
| 2,013,027 | 9/1935 | Branch | 70/459 |

FOREIGN PATENT DOCUMENTS

| | | | |
|---|---|---|---|
| 1122017 | 5/1956 | France | 70/459 |
| 1462881 | 11/1966 | France | 70/459 |

*Primary Examiner*—Robert L. Wolfe

*Attorney, Agent, or Firm*—Sanford Astor

[57] ABSTRACT

This invention relates to a novel key ring holder which can be used with only one hand to remove or replace a key ring full of keys. The invention comprises the key ring holder adapted at one end to fit around a belt loop and at the other end adapted to hold a set of keys on a ring in which there is a button actuated spring which is movable by one finger to open and close a U-shaped slot while other fingers of the same hand remove or replace the key ring on the U-shaped slot.

5 Claims, 3 Drawing Figures

ONE-HAND KEY RING

BACKGROUND OF THE INVENTION

There are many key ring holders on the market which are adapted to fit around the belt loop of trousers or clip onto a belt. These devices are useful for workmen or other persons who have to reach their keys quite often and do not wish to have to reach into a pocket each time.

Each of the devices now known requires both hands to operate. The user must hold the holder open with one hand and remove or insert the key ring with the other.

OBJECTS OF THE INVENTION

It is an object of the present invention to provide a key ring holder that can be operated with one hand.

It is a further object to provide a key ring holder which is adapted to fit around a belt loop or hook onto a belt at one end and hold a ring of keys at the other which can be operated with one hand.

There are many occasions when a person is holding things in one hand which prevent the use of that hand from reaching his keys even though they are on a holder on his belt or pants. He still has to place what he is holding down to reach his keys. This invention alleviates that problem.

DESCRIPTION OF THE INVENTION

These objects and others will be obvious from the description of the invention and the drawings in which.

Figure 1:
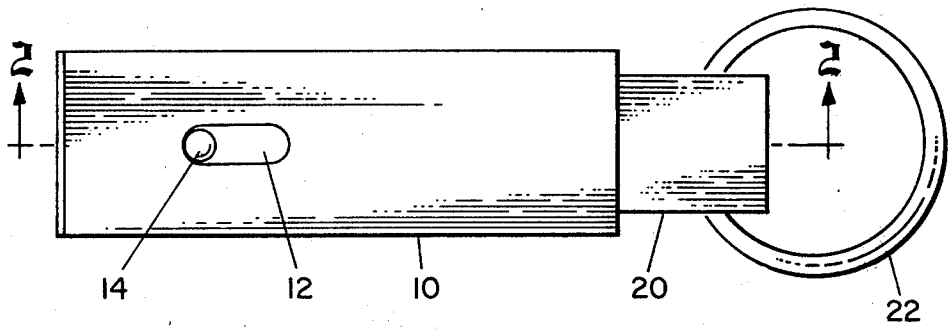
FIG. 1 is a back view of the invention.

Referring now to all three drawings, there is shown the outer shell 10 which consists of a piece of tubing made from any convenient material such as aluminum. The body 10 has a slot 12 in which a button 14 is slidably mounted. The button 14 is fixedly attached to the main body portion 16 which comprises a U-shaped portion 18 disposed within the outer shell 10 and another U-shaped portion 20 which holds the key ring 22, shown without keys.

Disposed within the U-shaped portion 18 of the main body 16 is a spring 24. The spring is held between one side of the U-shaped portion 18 and a retaining block 26 which is held in position by a pin 28.

Figure 2:
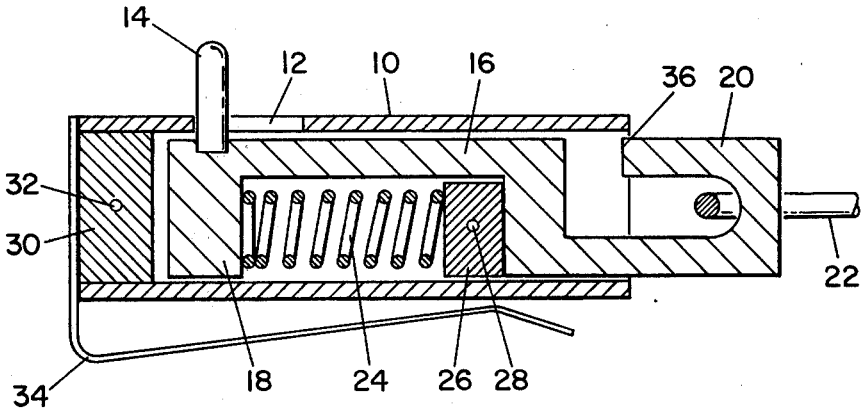
FIG. 2 is a cut-away view of the invention in the closed position.
Figure 3:
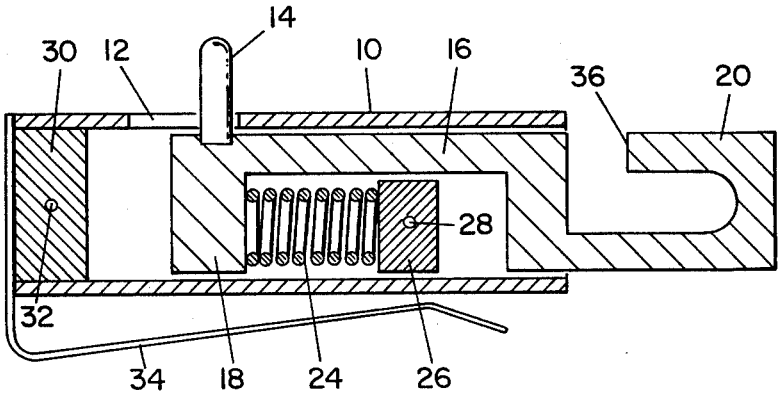
FIG. 3 is a cut-away view in the open position.

A reinforcing block 30 fits in the end of the outer shell 10. A hole 32 is placed in the reinforcing block adapted to receive a ring (not shown) which would fit around a belt loop or any other article of clothing or purse or bag to hold the device of this invention. As shown in FIG. 2 and FIG. 3, the device has a clip 34 which is adapted to slide over a man's belt and frictionally hold to the belt.

In operation the key ring holder hangs in a vertical direction with the U-shaped key ring holder 20 at the lower end. In FIG. 2 the spring is in the relaxed position and the U-shaped portion 18 rests against retaining block 26. In this position, the open arm 36 of key ring holder 20 rests just inside outer shell 10, so that the key ring cannot slip off.

In FIG. 3, the spring 24 is shown in the compressed position. When has occurred is that the user has pushed down on button 14 with his thumb. This compresses spring 24 against retaining clock 26. The U-shaped portion 16 slides downwardly in outer shell 10, exposing the open arm 36 of U-shaped portion 20 so that the key ring 22 can be either inserted or removed with the fingers of the same hand.

Having thus described the invention, it is requested that the invention be limited only by the scope of the appended claims.

I claim:

1. A key ring device adapted to be attached at one end to a piece of clothing and to hold a ring of keys at the other comprising a tubular outer shell, a slot disposed within said outer portion, a U-shaped inner body, a spring disposed within said U-shaped inner body, a button fixedly attached to said U-shaped inner body which button passes through the slot in the outer shell, said inner body comprising a U-shaped key ring holder portion, means to attach the key ring device to a piece of clothing.

2. The device of claim 1 comprising a retaining block fixedly attached within said outer shell for holding the spring in position.

3. The device of claim 1 in which said means to attach the key ring device is a split ring adapted to fit over a belt loop.

4. The device of claim 1 in which said means to attach the key ring device is a friction clip.

5. The device of claim 2 comprising a reinforcing block disposed in said outer shell abutting said U-shaped body.

* * * * *